US011471006B2

(12) United States Patent
Eivaz

(10) Patent No.: US 11,471,006 B2
(45) Date of Patent: Oct. 18, 2022

(54) SOAP-DISPENSING BATH SPONGE ASSEMBLY

(71) Applicant: Ahmad Eivaz, San Marcos, CA (US)

(72) Inventor: Ahmad Eivaz, San Marcos, CA (US)

( * ) Notice: Subject to any disclaimer, the term of this patent is extended or adjusted under 35 U.S.C. 154(b) by 215 days.

(21) Appl. No.: 16/837,993

(22) Filed: Apr. 1, 2020

(65) Prior Publication Data

US 2020/0305654 A1 Oct. 1, 2020

Related U.S. Application Data

(60) Provisional application No. 62/827,491, filed on Apr. 1, 2019.

(51) Int. Cl.

| | |
|---|---|
| ***A47K 7/03*** | (2006.01) |
| ***A46B 11/00*** | (2006.01) |
| ***A47K 7/04*** | (2006.01) |

(52) U.S. Cl.

CPC ..... *A47K 7/03* (2013.01); *A46B 11/0041* (2013.01); *A47K 7/043* (2013.01); *A46B 2200/1006* (2013.01)

(58) Field of Classification Search

CPC . A47K 7/03; A47K 7/04; A47K 7/043; A46B 17/06

See application file for complete search history.

(56) References Cited

U.S. PATENT DOCUMENTS

| | | | | |
|---|---|---|---|---|
| 9,439,550 | B2 * | 9/2016 | Celia | A47L 13/17 |
| 10,986,979 | B2 * | 4/2021 | Sullivan | A47L 13/16 |
| 2004/0096260 | A1 * | 5/2004 | Rhoades | A47K 7/03 401/8 |
| 2013/0058698 | A1 * | 3/2013 | Hasidashvili | A47K 7/03 401/6 |

FOREIGN PATENT DOCUMENTS

| | | | | |
|---|---|---|---|---|
| CA | 2491170 | A1 * | 6/2006 | A46B 11/0079 |

* cited by examiner

*Primary Examiner* — Michael D Jennings

(74) *Attorney, Agent, or Firm* — CP Law Group PC; Cy Bates

(57) ABSTRACT

A soap-dispensing bath sponge assembly is adapted to house a liquid soap product within a body thereof, and further adapted to dispense soap through an exfoliating material, such as a brush and/or sponge material, thereby creating a foamy lather for application to the body of a user or non-human surface, such as a vehicle. The body of the soap-dispensing bath sponge assembly is adapted to be flexibly-modulated (squeezed), thereby generating pressure within an internal volume of the body, forcing the liquid soap product through slit valves (or similar features) and into a volume of the exfoliating material.

19 Claims, 3 Drawing Sheets

SOAP-DISPENSING BATH SPONGE ASSEMBLY

CROSS-REFERENCE TO RELATED APPLICATIONS

This invention claims benefit of priority with U.S. Provisional App. Ser. No. 62/827,491, filed Apr. 1, 2019; the entire contents of which are hereby incorporated by reference.

BACKGROUND OF THE INVENTION

Field of the Invention

This invention relates to an improved bath sponge; and more particularly, to a soap-dispensing bath sponge assembly which is adapted to house and dispense soap for application during bathing.

DESCRIPTION OF THE RELATED ART

A myriad of sponges and sponge-like products are commercially available and each is designed for utilization as a bathing implement, or more specifically, an implement for exfoliating skin during bathing, or otherwise washing a surface such as that of a vehicle or other object.

Typically, a user applies an amount of soap or body wash to a surface of the sponge and commences an exfoliating wash.

Often, there is limited space in the shower or tub area, and many products are loosely stored within bottles kept in the vicinity of a bath or shower. As such, bottles are often unintentionally tipped-over, broken, and product can be wasted.

It would be an improvement in the art to combine a sponge and a bottle containing soap in such a way as to reduce the required storage space, eliminate potential for loss of spilled product, and to improve the act of applying soap to a sponge thereby enhancing the experience during bathing.

SUMMARY

The disclosure concerns a soap-dispensing bath sponge assembly that is adapted to house a liquid soap product within a body thereof, and further adapted to dispense soap through an exfoliating material, such as a brush and/or sponge material, thereby creating a foamy lather for application to the body of a user or non-human surface, such as a vehicle. The body of the soap-dispensing bath sponge assembly is adapted to be flexibly-modulated (squeezed), thereby generating pressure within an internal volume of the body, forcing the liquid soap product through slit valves (or similar features) and into a volume of the exfoliating material.

Other features and advantages will become apparent upon a thorough review of the disclosure in its entirety.

BRIEF DESCRIPTION OF THE DRAWINGS

These and other features and aspects are described in the appended details and descriptions, particularly when referenced in conjunction with the following drawings, wherein.

DETAILED DESCRIPTION

For purposes of explanation and not limitation, details and descriptions of certain preferred embodiments are hereinafter provided such that one having ordinary skill in the art may be enabled to make and use the invention. These details and descriptions are representative only of certain preferred embodiments, however, and a myriad of other embodiments which will not be expressly described will be readily understood by one having skill in the art upon a thorough review of the instant disclosure. Accordingly, any reviewer of the instant disclosure should interpret the scope of the invention by the claims, as such scope is not intended to be limited by the embodiments described and illustrated herein.

In accordance with the details and descriptions herein, an soap-dispensing and exfoliating bath sponge assembly is disclosed, the sponge assembly comprises: a dome-shaped body, an exfoliating material configured to attach to an underside of the dome-shaped body, and an opening extending through the dome-shaped body, the opening associated with a stopper, wherein the stopper is configured to engage and plug the opening to maintain an amount of liquid soap product within an internal cavity volume of the dome-shaped body.

In a preferred embodiment, the dome-shaped body is molded using conventional techniques and an elastomeric composition, and is provided as being flexible, such that a flex of the dome results in dispensing of liquid soap product into a volume of the exfoliating material (sponge and/or brush material). The dome-shaped body may comprise a circular, polygonal, or elliptical base, and may further comprise a generally hemispherical surface extending from the base. The base may comprise one or more valves, such as slit valves, or similar features, for delivering the liquid soap product to the exfoliating material for creating a foamy lather and applying such to the body of a user.

The dome-shaped body is generally hollow and surrounds a cavity, and associated interior cavity volume, therein.

Figure 1:
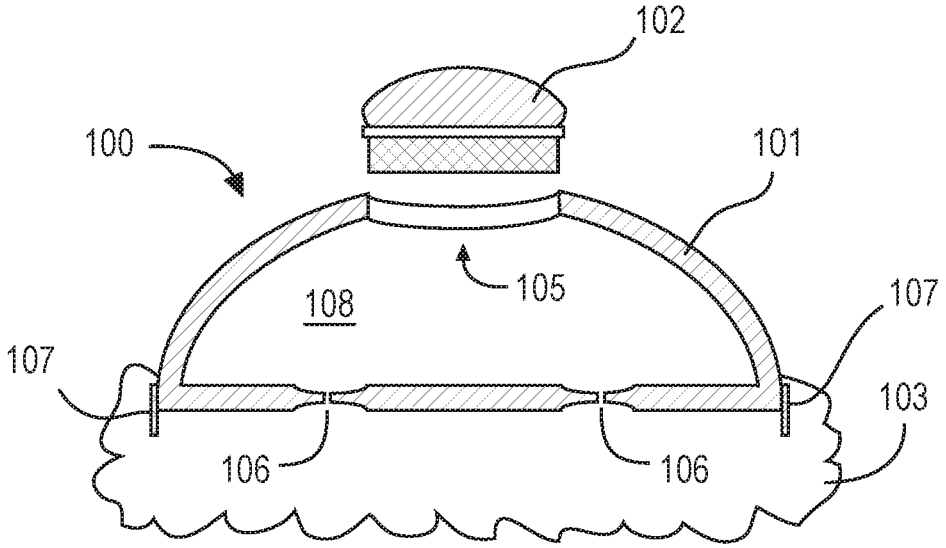
FIG. 1 shows a section view of an exfoliating bath sponge assembly.
Figure 3:
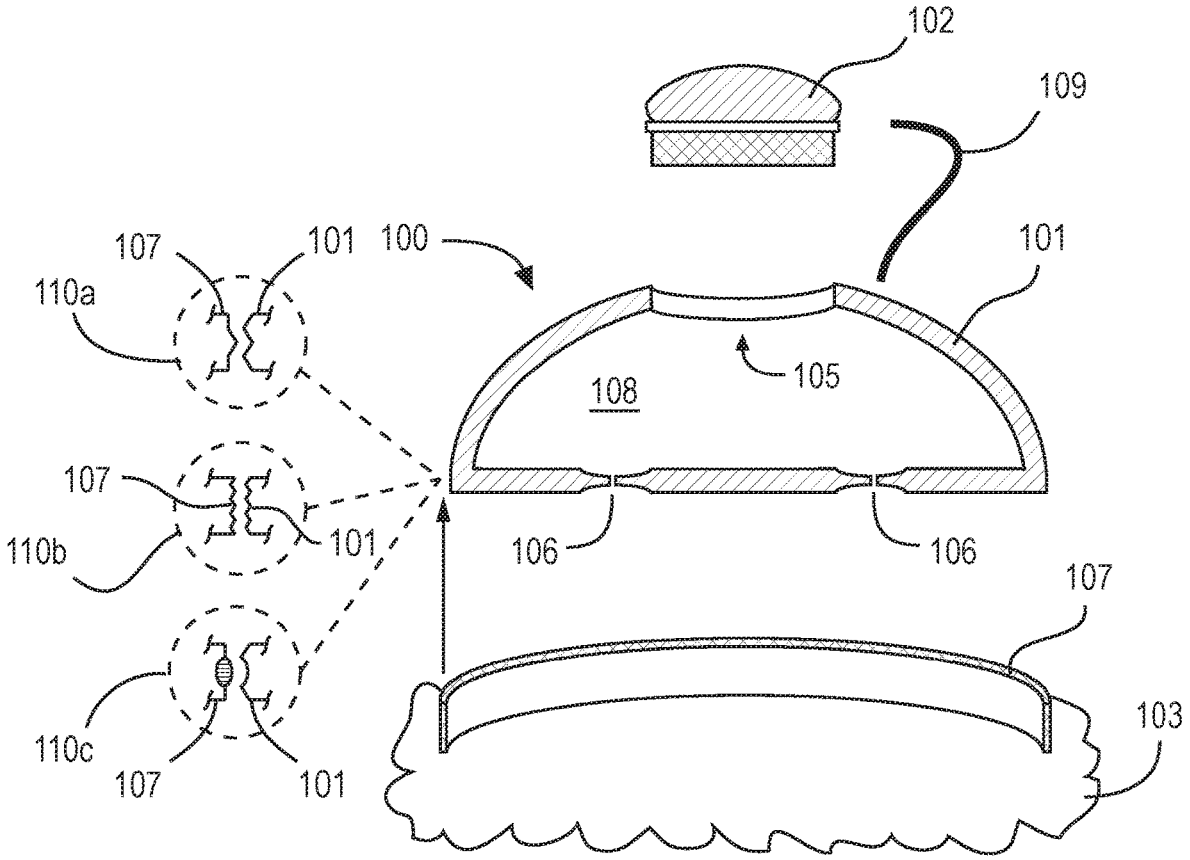
FIG. 3 shows an exploded view of the exfoliating bath sponge assembly.

Now, turning to the drawings, wherein the invention is illustrated in accordance with a preferred embodiment, FIG. 1 shows a section view of the bath sponge assembly 100. The sponge assembly includes a dome-shaped body 101 having an opening 105 disposed at an apex thereof (although in other embodiments the opening can be placed at any position about the dome-shaped body). Engaged with the opening is a stopper 102 (and optional leash, 109; FIG. 3), wherein the stopper is configured to engage and plug the opening to maintain an amount of liquid soap product within the dome-shaped body. The stopper can be adapted to engage the opening with mechanical elements (snap-fitment) (110*a*; FIG. 3), threaded fit (110*b*; FIG. 3), magnetism (110*c*; FIG. 3), or any similar technique appreciated by one having skill in the art. The dome shaped body is generally flexible, such that a user may depress the dome-shaped body thereby increasing pressure within an internal volume 108 of the dome-shaped body. The dome-shaped body may comprise a circular, polygonal, or elliptical base, about a planar bottom surface, with one or more slit-valves 106 disposed therein (two valves are shown, however one or more may be similarly implemented). In this regard, as pressure is increased within the internal volume of the dome-shaped body, liquid soap material is evacuated from the internal volume through the one or more slit-valves. Adjacent to the base of the dome-shaped body is configured an exfoliating material 103, such as a bristle containing (brush) material, a fabric or sponge-like material, which may be obtained from a natural or synthetic source. The exfoliating material can be attached at the base by implementing any known technique, in particular those illustrated in FIG. 3. For example, the exfoliating material may be attached to an annular support member 107, and the annular support member may be configured to attach to a portion of the flexible dome-shaped body 101 by any of a myriad of possible means known to one with skill in the art, for example, by way of friction fitment, mechanical elements, magnetic elements, threads and the like.

Figure 2:
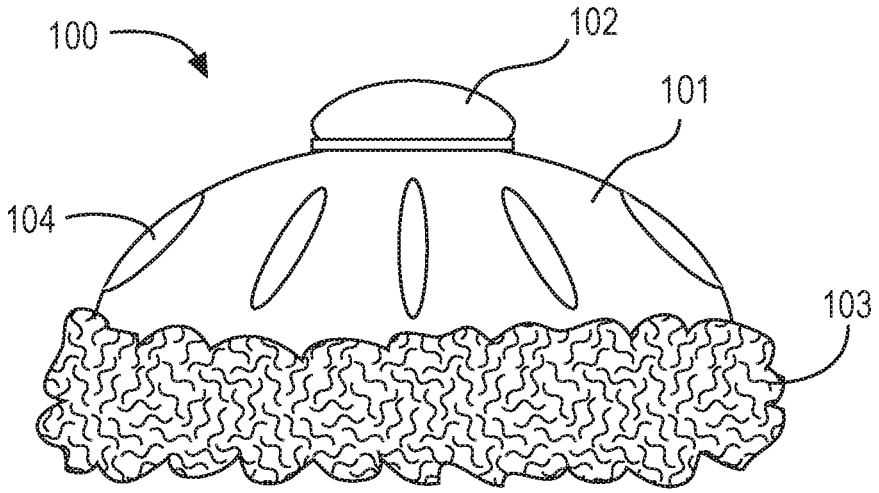
FIG. 2 shows a side view of the exfoliating bath sponge assembly.

FIG. 2 shows a side view of the soap-dispensing bath sponge assembly 100, including, dome-shaped body 101, exfoliating material 103 coupled to the dome-shaped body, and a stopper 102 for closing an opening about at surface of the dome-shaped body. One or more grooves 104 can be implemented about a surface of the dome-shaped body for providing grip enhancement.

FIG. 3 shows an exploded view of the soap-dispensing bath sponge assembly 100. Here, the stopper 102 is detached from the opening 105, and the exfoliating material 103 is detached from the dome-shaped body 101. The illustration shows various mechanisms for attaching/releasing the exfoliating material from the dome-shaped body; however, snap features 110*a*, threaded attachments 110*b*, magnetic attachments 110*c*, and other attachments may be similarly implemented in accordance with the level of skill in the art. As shown, each mechanism details a corresponding feature of the body 101 and the annular support member 107 for illustrating various engagement schemes. At the base of the flexible dome-shaped body 101 is disposed slit-valves 106, which are each configured to dispense liquid soap product from within the interior cavity volume 108 of the body into the exfoliating material 103 adjacent therewith. Optional leash attachment 109 is shown for securing the stopper to the flexible dome-shaped body.

Figure 4:
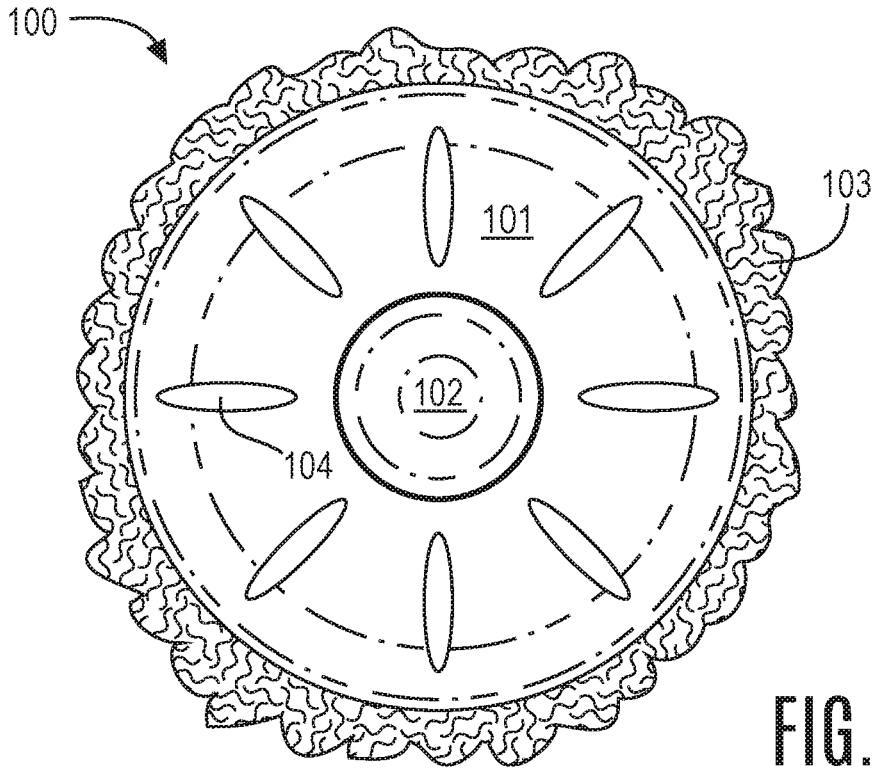
FIG. 4 shows a top view of the exfoliating bath sponge assembly.

FIG. 4 shows a top plan view of the soap-dispensing bath sponge assembly, including the stopper 102, dome-shaped body 101, and exfoliating material 103. From this view, a plurality of grooves 104 are shown, each of the grooves is optional but preferred and is configured to provide enhanced gripping of the exfoliating bath sponge.

Figure 5:
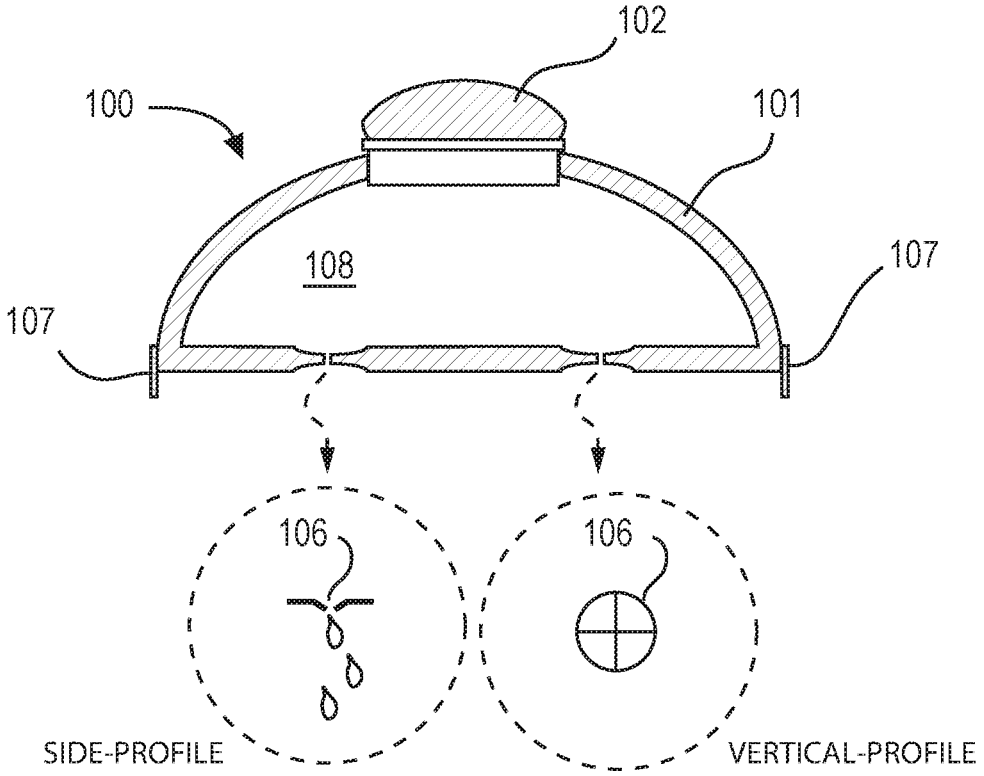
FIG. 5 shows a section view of the exfoliating bath sponge assembly.

FIG. 5 shows a section view of the body 101 and stopper 102 of the soap-dispensing bath sponge assembly 100 (exfoliating material omitted), with additional exploded sub-views (SIDE-PROFILE; and VERTICAL PROFILE) showing the slit-valves 106 in "open" and "closed" configurations, respectively, as well as a plan view of an exemplary slit-valve showing a quad-sector configuration. It is important to note that while a slit-valve with four sectors is shown, any number of slits may be implemented to arrive at a slit valve capable of dispensing the liquid soap product as intended herein. Soap or body wash (collectively referred to as "liquid soap product") is dispensed from an interior cavity volume 108 of the dome-shaped body, through the slit-valves 106, into a volume of the exfoliating material (omitted, see 103; FIG. 1) for producing a foamy lather ready for application to the body of a user. While the exfoliating material is omitted for clarity, the portion which couples the exfoliating material to the body, namely, the annular support member 107, is shown attached to the body. The mechanism for attachment can be any that would be appreciated by one with skill in the art. Additionally, although the term annular support member is used herein, any mechanism for attaching the exfoliating material to the body, as would be appreciated by one having skill in the art, may be incorporated.

Where slit-valves are disclosed in the preferred embodiment, it will be appreciated by one having skill in the art that any similar valve can be implemented without departing from the spirit and scope of the invention.

The exfoliating material may comprise spun fibers, fabric, sponge, polymer, cellulose, loofa, or any material commonly known for use as an exfoliating material.

The exfoliating material may be attached to the dome-shaped body using friction fitment, mechanical elements, threaded (screw-like) elements, magnetic elements, and/or the like.

The slit-valves may be fabricated from a thin-plastic layer by cutting slits to form the respective slit-valves. Alternatively, the valves can be inserted into the base of the dome-shaped body. Other known techniques can be similarly implemented.

The dome-shaped body may be fabricated from a flexible polymer or elastomer, such as silicone, rubber, or a combination thereof.

As used herein, the term "hemispherical" means a curved bulb-like surface, and is not required to have an equal radius from a center when taken at any given point of the surface. In this regard, the surface of the body can be any curved surface and is not required to be a perfect hemisphere.

As an advantage of the disclosed sponge assembly, the exfoliating material can be detached from the body, and replaced as necessary with a fresh equivalent such that the body and stopper are reusable and only the exfoliating material requires occasional replacement.

While certain details and descriptions have been provided herein for the purpose of illustrating to one having skill in the art how to make and use the invention, it should be understood that other features, embodiments and arrangements of the elements disclosed herein can be appreciated without departing from the spirit and scope of the invention as-claimed.

FEATURE LISTING bath sponge assembly 100
dome-shaped body 101
stopper 102
exfoliating material 103
grooves 104
opening 105
slit-valve 106
annular support member 107
interior cavity volume 108
leash, 109
snap-fitment mechanical element 110*a*
threaded fit mechanical element 110*b*
magnetic mechanical element 110*c*

What is claimed is:

1. A soap-dispensing bath sponge assembly, comprising:

a dome-shaped body, the dome-shaped body comprising a base and a hemispherical surface extending from the base, wherein one or more slit-valves are positioned on the base, and an opening is positioned on the hemispherical surface;

a stopper configured to engage the dome-shaped body at the opening and seal an interior cavity volume of the dome-shaped body; and an exfoliating material coupled to the base of the dome-shaped body;

wherein the exfoliating material is coupled to the dome-shaped body via an annular support member disposed therebetween.

2. The soap-dispensing bath sponge assembly of claim 1, the stopper comprising a magnetic element, wherein the stopper is configured to form a magnetic attachment with the dome-shaped body at the opening.

3. The soap-dispensing bath sponge assembly of claim 1, wherein the stopper is configured to form a friction-fit attachment with the dome-shaped body at the opening.

4. The soap-dispensing bath sponge assembly of claim 1, each of the stopper and the opening comprising threads, wherein the stopper is configured to form a threaded attachment with the dome-shaped body at the opening.

5. The soap-dispensing bath sponge assembly of claim 1, wherein the dome-shaped body is flexible with applied pressure such that soap within the interior cavity volume of the dome-shaped body is expelled through the slit-valves and into the exfoliating material upon said applied pressure.

6. The soap-dispensing bath sponge assembly of claim 1, wherein the annular support member and a periphery of the dome-shaped body comprise snap features, threaded attachments, or magnetic attachments for establishing a coupling therebetween.

7. The soap-dispensing bath sponge assembly of claim 1, wherein the dome-shaped body further comprises one or more grooves disposed on the surface thereof for enhancing gripping of the soap-dispensing bath sponge assembly.

8. The soap-dispensing bath sponge assembly of claim 1, wherein the dome-shaped body comprises a molded piece.

9. The soap-dispensing bath sponge assembly of claim 1, wherein the dome-shaped body comprises an elastomeric composition.

10. The soap-dispensing bath sponge assembly of claim 1, wherein the opening is positioned at an apex of the dome-shaped body.

11. The soap-dispensing bath sponge assembly of claim 1, wherein the stopper is configured to physically separate from the dome-shaped body.

12. The soap-dispensing bath sponge assembly of claim 1, wherein the annular support member is connected to the exfoliating material.

13. A soap-dispensing bath sponge assembly, comprising:

a dome-shaped body, the dome-shaped body comprising a base and a hemispherical surface extending from the base, wherein one or more slit-valves are positioned on the base; and an exfoliating material coupled to the base of the dome-shaped body;

wherein the exfoliating material is coupled to the dome-shaped body via an annular support member disposed therebetween.

14. The soap-dispensing bath sponge assembly of claim 13, further comprising an opening is positioned on the hemispherical surface.

15. The soap-dispensing bath sponge assembly of claim 14, wherein the opening is positioned at an apex of the dome-shaped body.

16. The soap-dispensing bath sponge assembly of claim 14, further comprising a stopper configured to engage the dome-shaped body at the opening and seal an interior cavity volume of the dome-shaped body.

17. The soap-dispensing bath sponge assembly of claim 16, wherein the stopper is configured to physically separate from the dome-shaped body.

18. The soap-dispensing bath sponge assembly of claim 13, wherein the annular support member and a periphery of the dome-shaped body comprise snap features, threaded attachments, or magnetic attachments for establishing a coupling therebetween.

19. The soap-dispensing bath sponge assembly of claim 13, wherein the annular support member is connected to the exfoliating material.

* * * * *